United States Patent [19]

Lingl, Jr. et al.

[11] 4,131,072

[45] Dec. 26, 1978

[54] APPARATUS FOR INDIVIDUAL CONTROLLED DISTRIBUTION OF POWDERED SOLID FUEL TO PLURAL BURNING UNITS

[75] Inventors: Hans Lingl, Jr.; Don E. Denison, both of Paris, Tenn.

[73] Assignee: Lingl Corporation, Paris, Tenn.

[21] Appl. No.: 800,855

[22] Filed: May 26, 1977

[51] Int. Cl.[2] ..... F23K 3/02

[52] U.S. Cl. ..... 110/106; 110/232; 110/327; 432/159; 302/51

[58] Field of Search ..... 110/106, 105, 104 R, 110/101 CF, 101 R, 327, 232; 432/1, 22, 36, 20, 51, 53, 58, 159; 236/1 A, 15 BA, 15 BD; 302/57, 51; 222/193, 266, 270, 564

[56] References Cited

U.S. PATENT DOCUMENTS

| | | | |
|---|---|---|---|
| 1,628,609 | 5/1927 | Newhouse | 110/106 |
| 1,741,184 | 12/1929 | Denison | 110/104 R |
| 1,898,086 | 2/1933 | Frisch | 110/106 |
| 2,259,967 | 10/1941 | Vogel-Jorgensen | 110/106 |
| 2,511,017 | 6/1950 | Sherban | 110/106 |
| 2,654,331 | 10/1953 | Mosshart | 110/104 R |
| 3,504,945 | 4/1970 | Leibundgut et al. | 302/51 |
| 3,969,068 | 7/1976 | Miller et al. | 110/106 |

*Primary Examiner*—Henry C. Yuen

*Attorney, Agent, or Firm*—Cushman, Darby & Cushman

[57] ABSTRACT

Apparatus is disclosed for individually and independently controlling the distribution of powdered solid fuel to each of a plurality of individual burners. A plurality of fuel outlet ports respectively and individually corresponding to individual ones of the plural burners are aligned with and spaced from a respectively corresponding plurality of air outlet ports. The air oulet ports are individually and controllably supplied with pressurized air while a supply of powdered solid fuel is fed into the spaces between the fuel outlet ports and the air outlet ports. In the preferred embodiment, a baffle is disposed between each pair of respectively corresponding fuel outlet and air outlet ports.

16 Claims, 3 Drawing Figures

APPARATUS FOR INDIVIDUAL CONTROLLED DISTRIBUTION OF POWDERED SOLID FUEL TO PLURAL BURNING UNITS

This invention generally relates to apparatus for the distribution of powdered solid fuel to a plurality of burning units. It has particular application for burners used in the temperature controlled zones of kilns such as used in the ceramic industry, e.g., brick curing kilns and the like wherein the temperature profile of the plurality of burner pipes must be properly controlled so as to achieve desired firing effects.

The invention described in this application represents an improvement over method and apparatus described in U.S. patent application, Ser. No. 772,238, filed Feb. 25, 1977 now U.S. Pat. No. 4,092,094 naming Hans Lingl, Jr as the inventor and assigned in common with the present application to the Lingl Corporation. The description of this earlier related invention as well as the brief description of prior art techniques, etc., already described in said U.S. application Ser. No. 772,238 is hereby incorporated by reference in the present application.

Briefly, as described in more detail in the related copending application Ser. No. 772,238, earlier powdered coal firing systems encounter difficulty in controlling the feeding rates to the individual burners of a controlled group. Some of these earlier systems are also quite sensitive to the grain size of the powdered coal and/or its moisture content while others require mechanical distribution means involving bearings, seals, and the like which wear and need constant maintenance, especially under conditions such as those encountered with powdered solid fuels (e.g., coal) as the working medium.

The earlier invention of Mr. Hans Lingl, Jr described in application Ser. No. 772,238 is a system having less sensitivity to grain size and moisture content and which requires no mechanical moving parts in contact with the powdered solid fuel. This earlier system nevertheless enables an operator to control the fuel feeding rates to the individual burners relative to one another. Furthermore, this earlier system permits continuous or intermittent firing.

In brief summary, the preferred exemplary embodiment described in application Ser. No. 772,238 includes a distributor formed from an annular housing and having output ports spaced about its periphery. A fuel inlet port is then formed as a central opening on the top side of the housing and connected to receive a supply of powdered solid fuel from a storage container located thereabove. A stop plate, approximately the same dimensions as the central opening and registered therewith, is suspended below the central opening at a height intermediate the output ports such that powdered solid fuel is gravity fed to spill over the edges of the stop plate into the vicinity of the output ports. In this earlier preferred exemplary embodiment, an air inlet port is also provided having an opening on the bottom side of the housing under the stop plate and connected to a source of pressurized air such that the incoming powdered coal is caused to pass downwardly directly into the path of an air current between the air inlet and air outlet ports. The outlet ports in this earlier embodiment are supplied with a controllable amount of auxiliary compressed air thereby determining the relative amounts of coal supplied to the individual outlet ports of a given coal distributor.

However, although the distributor described in U.S. application Ser. No. 772,238 does permit one to adjust the relative amounts of coal being fed to the individual burners, it does not permit one to feed the individual burners in a completely individual and independent manner. In particular, one cannot adjust the feed to individual burners without influencing neighboring burners so that if the feed rate to a given burner is increased, the feed rate to the other burners is decreased by a similar relative amount. Furthermore, in this earlier distributor as described in application Ser. No. 772,238, variations in the flow of powdered coal over the edges of the stop plate may have an effect on the distribution of the coal into the individual outlet ports.

Now, however, with the present invention, it has been discovered that by the use of directed air streams having individually controlled quantities of air issuing therefrom and being individually registered with corresponding output ports connected to each of the burning units, one may control the feed of coal or other powdered solid fuel to individual burners without substantially influencing the coal being fed to neighboring burners. In other words, with the present invention, substantially completely individual and independent controlled distribution of powdered solid fuel to each of a plurality of individual burners has been achieved whereas, with the earlier distributor described in application Ser. No. 772,238, only relative control was possible over the individual coal supply to the individual burners. At the same time, the present invention is less sensitive than the earlier distributor with regard to variations in the flow of coal over the stop plate. It is also easier to adjust as will be apparent from the following description.

In the presently preferred exemplary embodiment of this invention, the coal distributor unit is mounted beneath a storage container or hopper. The distributor itself is formed from a cylindrical or annular housing having fuel outlet ports spaced about its outer periphery. A central opening on the top side of the housing acts as a fuel inlet port and is connected with the storage container thereabove so that powdered solid fuel is gravity fed through this central opening. A stop plate of approximately the same dimensions as the central opening is registered therewith and mounted below the central opening with its top level preferably being above the center line of the fuel outlet ports such that air outlet openings are disposed therebelow about its perimeter and in coaxial registry with the fuel outlet ports disposed about the outer periphery of the annular housing.

In the preferred exemplary embodiment, the air outlet openings or nozzles are elongated and horizontally oriented so as to bring the air outlets closer to the fuel (coal-air) outlet ports yet remaining within the body of powdered coal spilling over the edge of the stop plate. Separate air flues or conduits are preferably used for connecting the air outlet ports with individually controllable pressurized air feed lines decending below the stop plate and connecting to a common manifold which is, in turn, supplied with pressurized air.

Furthermore, in the preferred exemplary embodiment, dividers or baffles disposed between the stop plate and the annular housing of the coal distributor are arranged between every pair of air and fuel outlets so as to prevent air from flowing between such pairs of air and fuel outlets in what would otherwise be connecting spaces. Such baffles are preferably disposed between the annular housing and the stop plate such that the powdered solid fuel spilling over the edges of the stop plate acts to finish sealing off the individual fuel outlets from one another.

The pressurized air supply to the manifold is also preferably equipped with a solenoid or other control valve so as to permit temperature control of the overall burner group supplied by the distributor between on/-off or high/low or other desired limits or to permit impulse firing of the entire burner group by interrupting the air flow to the manifold in adjustable and/or periodic time intervals.

These and other features and advantages of this invention will become more clearly apparent from the following detailed description taken in conjunction with the accompanying drawings, of which:

Figure 1:
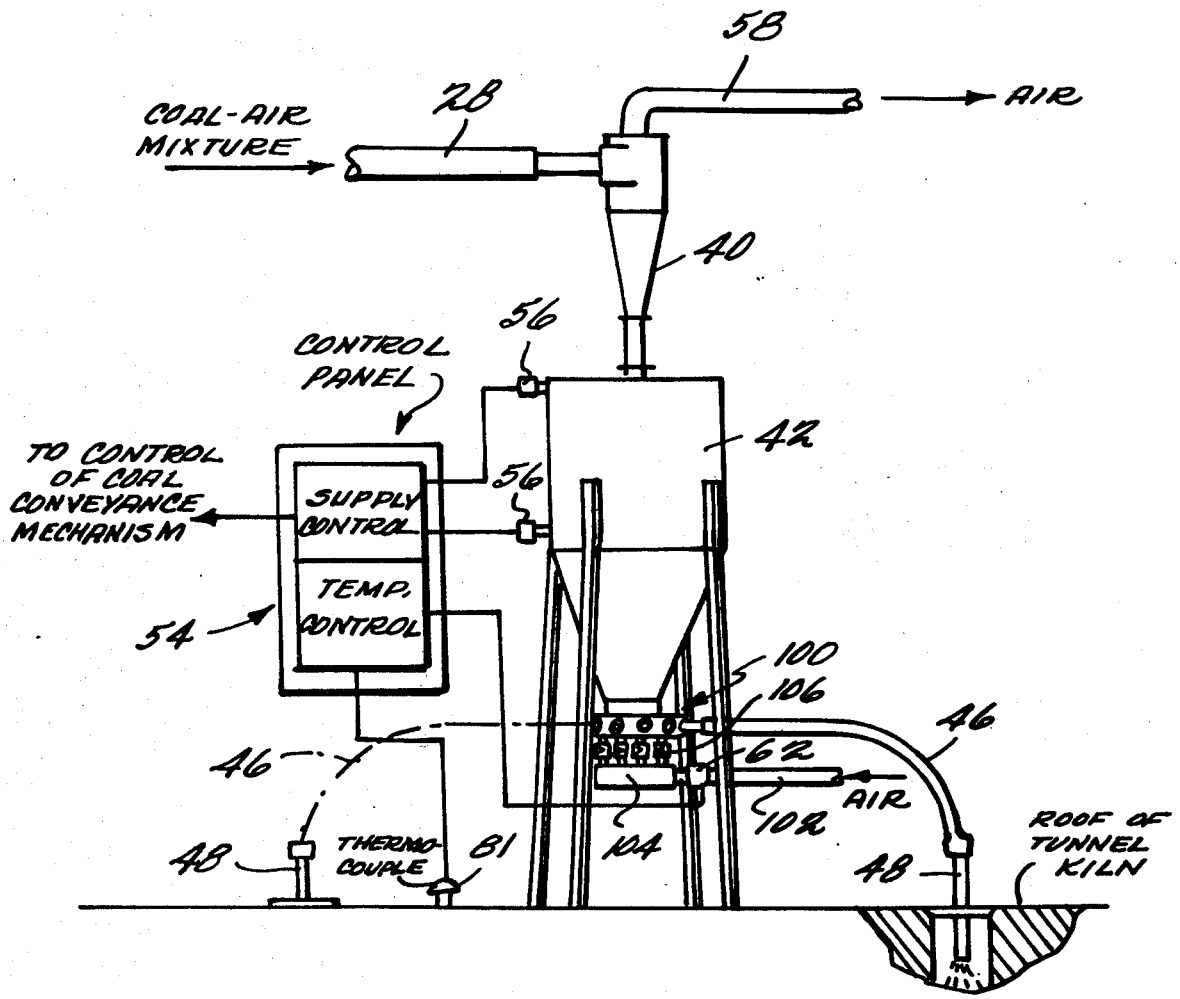
FIG. 1 is a side view of a complete coal distributing unit showing part of a fuel supply and storage mechanism as well as burning units supplied by the distributor.

A more complete detailed description of a complete system for accepting lump coal, drying it, grinding it, conveying it, and distributing it to individual burners of a group of such burners located in the roof of a tunnel kiln is shown in FIG. 1 and the accompanying description in related copending U.S. application Ser. No. 772,238. The portion of such apparatus embodying the present improvement invention is shown in FIG. 1 of this application. As shown, this is the portion of the apparatus which is normally mounted on the roof of the tunnel kiln in the preferred exemplary embodiment and application to be described in detailed herein.

For ease of understanding and cross referencing purposes, the components of the present invention shown in FIG. 1 hereof which are also incorporated in the preferred exemplary embodiment described in more detail in copending related application Ser. No. 722,238 have been designated with the same reference numerals as those used in the copending related application.

As shown in FIG. 1, the distribution system in the preferred exemplary embodiment is disposed on the top of a tunnel kiln in the proximity of the individual burners 48 of a particular control group of such burners to be supplied with powdered solid fuel such as coal.

A coal-air mixture is then pneumatically conveyed through supply line 28 to a precipitator 40 in which the powdered solid coal is separated from the air. The separated clean air is discharged through line 58 while the separated coal is dropped from the precipitator into an intermediate storage container 42. The separated air from line 58 may be routed into the rapid cooling system of a tunnel kiln or to operate the coal distributing system for the individual burners (which requires a source of pressurized air as will be explained in more detail below) or to other desired uses.

From the storage container 42, the powdered solid coal is gravity fed into the improved distributor 100 of this invention where the coal is controllably (both individually and independently) fed to the individual burner supply lines 46 which supply the burner pipes 48 installed in lids on openings in the roof of the tunnel kiln as shown.

Level sensors or detectors 56 are provided at minimum and maximum levels in the storage container 42 or other desired levels so as to supply necessary information to the supply control portion of a control panel which, in turn, is used to control a coal conveyance mechanism, such as a pneumatic conveyor in the preferred exemplary embodiment. As also shown in FIG. 1, the air supply line 102 is equipped with a solenoid valve or similar control means 62 for off/on or high/-low temperature control via the control panel 54 and the thermocouple 81. As has already been explained in the related copending application Ser. No. 772,238, the temperature control portion of the control panel may also include mechanism for controlling the solenoid valve 62 at successive time intervals so as to achieve impulse control over the firing of the burner group.

Figure 2:
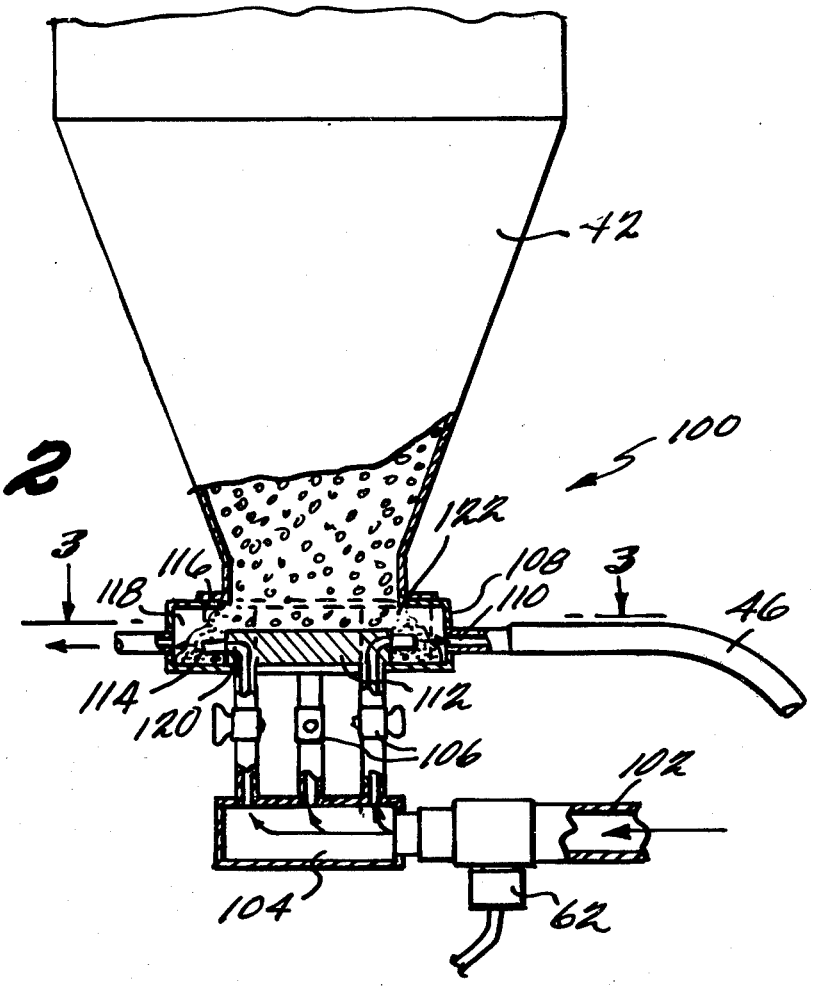
FIG. 2 is a more detailed and partially cutaway side view of a presently preferred exemplary embodiment of the storage container and distributor shown in FIG. 1.

As shown in more detail at FIG. 2, the pressurized air supply line 102 with the solenoid valve 62 feeds into a manifold 104 which is connected to the distributor 100 with individually controllable pipes having manual control valves 106 corresponding to each of the burner supply lines 46.

As shown in the preferred embodiment, the distributor 100 is formed from a cylindrical housing 108 having a plurality of fuel outlet ports 110 disposed at equal intervals about its circumference. The top end of the cylindrical housing 108 has a central opening or aperture mounted directly under the output of the storage container 42 such that powdered solid fuel (e.g., coal) is normally gravity fed through this central aperture. A stop plate 112 having approximately the same dimensions as the central aperture in the top of the cylindrical housing is disposed with its top surface registered with and below the central aperture. In the preferred exemplary embodiment, the top surface is slightly higher than the center of the fuel outlet ports 110.

A plurality of air outlet ports 114 are also provided, each being aligned with and spaced from a corresponding one of the fuel outlet ports 110. Preferably, these air outlet ports 114 comprise tubes extending horizontally and outwardly beyond the edges of the stop plate so as to come close to the surface 116 of the powdered solid fuel spilling over the edge of the stop plate 112. At the same time, the air outlet ports 114 do not extend so far horizontally as to be exposed into the space 118 located between the powdered solid fuel and the cylindrical housing 108. Also, in the preferred exemplary embodiment, at least the ends of the air outlet ports 114 comprise nozzles having outlet orifices of restricted areas so as to increase the velocity of air flow issuing therefrom.

As shown in FIG. 2, the air outlet ports 114 are connected through elbow flues 120 through the stop plate 112 to respectively corresponding ones of the individually controllable air supply lines. Accordingly, pressurized air is blown through each of the air outlet ports 114 in coaxial alignment with respectively corresponding fuel outlet ports 110. In this manner, powdered solid fuel is directly conveyed into the individual burner supply lines 46 to respectively corresponding individual burners 48.

Figure 3:
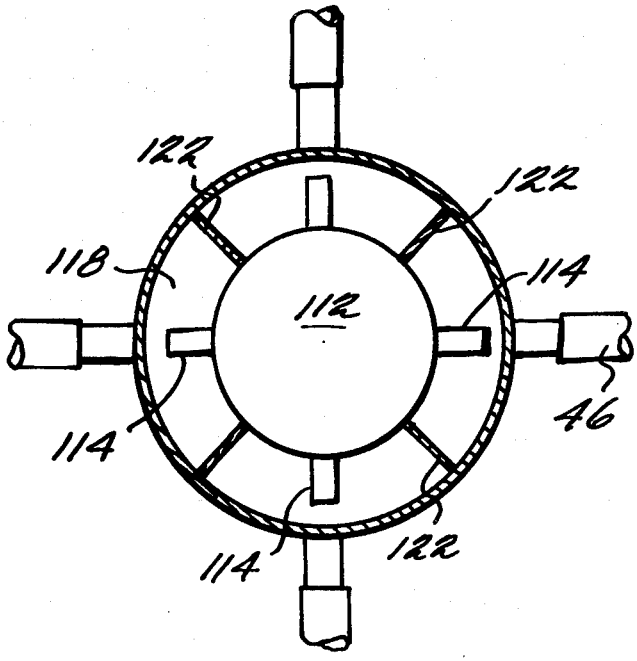
FIG. 3 is a cross sectional view of the distributor along lines 3—3 in FIG. 2.

Dividers or baffles 122 are disposed between the stop plate 112 and the outer periphery of the cylindrical housing 108 in the distributor so as to effectively separate and isolate the air spaces formed between every fuel outlet port 110 and its respectively associated air outlet port 114. The location of these baffles 122 is shown more clearly at FIG. 3. With such baffles in place, as the powdered solid fuel spills over the edge of the stop plate 112, the powdered solid fuel itself seals off and thereby creates individual air chambers respectively associated with each of the fuel outlet ports 110. Accordingly, such baffles facilitate independent and individual control over the feeding of different quantities of powdered solid fuel to each of the individual burners being supplied. That is, the supply of pressurized air to any given burner may be increased or decreased thereby directly increasing or decreasing the amount of powdered solid fuel being fed to a respectively corresponding burner without materially affecting the supply of powdered solid fuel to any other burner of the group. As shown in this preferred exemplary embodiment, the baffle plates 122 comprise substantially continuous transverse surfaces across the annular space formed within the cylindrical housing 108 between its outer periphery in the stop plate 112.

Although the preferred exemplary embodiment of this invention includes both the individually controlled air outlet ports and the baffle plates which are disposed so as to create individual air chambers (when sealed off by the powdered solid fuel) for each of the respectively associated fuel outlet ports, it should be appreciated that a degree of individual and independent fuel feed control may also be achieved without the baffle plates. It should also be appreciated that while this preferred exemplary embodiment has been described as being powered by pressurized air, other pressurized gases might also be utilized (e.g., a pressurized mixture of oxygen and other gases) and the term "pressurized air" is used in the specification and claims of this application as including such other pressurized gases as may be desired for particular applications.

While only one preferred exemplary embodiment of this invention has been described in detail above, those skilled in the art will recognize that many modifications may be made in this exemplary embodiment without materially departing from the novel and advantageous features of this invention. Accordingly, all such modifications are intended to be included within the scope of the invention as defined by the following appended claims.

What is claimed is:

1. Apparatus for individually and independently controlling distribution of powdered solid fuel to each of a plurality of individual burners, said apparatus comprising:

a plurality of fuel outlet ports, each adapted for connection with a respectively corresponding one of said burners;

a plurality of air outlet ports, each being aligned with and spaced from a corresponding one of said fuel outlet ports;

fuel supply means disposed in association with said fuel outlet ports and with said air outlet ports for feeding said powdered solid fuel into the spaces therebetween;

a baffle disposed between each pair of respectively corresponding fuel outlet ports and air outlet ports; and each of said air outlet ports being adapted for individual connection with a source of pressurized air through a valve thereby permitting individual control of the pressurized air supply thereto.

2. Apparatus as in claim 1 comprising a cylindrical housing with an aperture at one end for receiving the supply of powdered solid fuel and a stop plate disposed therebelow of approximately the same dimensions as the aperture wherein:

said fuel outlet ports are disposed about the periphery of said cylindrical housing, the center of the fuel outlet ports being disposed below said stop plate; and said air outlet ports are disposed below said stop plate.

3. Apparatus as in claim 2 wherein said fuel supply means comprises a fuel storage container mounted above said cylindrical housing and connected to gravity feed said powdered solid fuel downwardly through said aperture, over said stop plate and into the space between the air outlet ports and the fuel outlet ports.

4. Apparatus as in claim 2 wherein said baffles comprise substantially continuous transverse surfaces across the annular space formed within the cylindrical housing between its outer periphery and the stop plate.

5. Apparatus as in claim 2 wherein said air outlet ports extend horizontally and outwardly beyond the edges of the stop plate.

6. Apparatus as in claim 5 wherein at least a portion of each horizontally extending outlet port comprises a nozzle for supplying pressurized air through said air outlet port at an increased velocity.

7. Apparatus for individually and independently controlling distribution of powdered solid fuel to each of a plurality of individual burners, said apparatus comprising:

distributor means having a plurality of fuel outlet ports spaced apart therewithin, each of said fuel outlet ports being adapted for connection with a respectively corresponding one of said burners;

said distributor means also having a plurality of air outlet ports disposed within said apparatus, each of said air outlet ports being aligned with and spaced from a respectively corresponding one of said fuel outlet ports;

fuel supply means including stop plate means disposed in association with said fuel outlet ports and with said air outlet ports for feeding said powdered solid fuel onto said stop plate means from which it simultaneously gravity feeds into the spaces between said outlet ports; and individually controlled air supply lines connected to supply individually controllable quantities of pressurized air to each of said air outlet ports and to thereby individually control the quantities of said powdered solid fuel passing into said fuel outlet ports.

8. Apparatus as in claim 7 wherein each of said individually controlled air supply lines comprises an individually adjustable valve.

9. Apparatus as in claim 8 comprising a common air supply conduit connected to supply pressurized air to each of said individually controlled air supply lines.

10. Apparatus as in claim 9 comprising a common air supply valve in said common air supply conduit for simultaneously controlling the flow of pressurized air flowing through said air outlet ports.

11. Apparatus for individually and independently controlling distribution of powdered solid fuel to each of a plurality of individual burners, said apparatus comprising:

a plurality of fuel outlet ports, each adapted for connection with a respectively corresponding one of said burners;

a plurality of air outlet ports, each being aligned with and spaced from a corresponding one of said fuel outlet ports;

fuel supply means disposed in association with said fuel outlet ports and with said air outlet ports for feeding said powdered solid fuel into the spaces therebetween;

individually controlled air supply lines connected to supply individually controllable quantities of pressurized air to each of said air outlet ports, and a housing with an aperture at its top side for receiving the supply of powdered solid fuel and a stop plate disposed therebelow of approximately the same dimensions as the aperture wherein:

the center of the fuel outlet ports is disposed below said stop plate; and said air outlet ports are disposed below said stop plate.

12. Apparatus as in claim 11 wherein said fuel supply means comprises a fuel storage container mounted above said cylindrical housing and connected to gravity feed said powdered solid fuel downwardly through said aperture, over said stop plate and into the space between the air outlet ports and the fuel outlet ports.

13. Apparatus as in claim 8 wherein said air outlet ports extend horizontally and outwardly beyond the edges of the stop plate.

14. Apparatus as in claim 13 wherein at least a portion of each horizontally extending air outlet port comprises a nozzle for supplying pressurized air through said air outlet port at an increased velocity.

15. Apparatus as in claim 11 wherein said housing is cylindrical in shape and wherein said air outlet ports are disposed about the circumference of the cylindrical housing.

16. Apparatus for individually and independently controlling distribution of powdered solid fuel to each of a plurality of individual burners, said apparatus comprising:

a plurality of fuel outlet ports, each adapted for connection with a respectively corresponding one of said burners;

a plurality of air outlet ports, each being aligned with and spaced from a corresponding one of said fuel outlet ports;

fuel supply means disposed in association with said fuel outlet ports and with said air outlet ports for feeding said powdered solid fuel into the spaces therebetween;

individually controlled air supply lines connected to supply individually controllable quantities of pressurized air to each of said air outlet ports, and a baffle disposed between each pair of respectively corresponding fuel outlet ports and air outlet ports.

* * * * *